US010899126B2

(12) United States Patent
Sugiyama et al.

(10) Patent No.: US 10,899,126 B2
(45) Date of Patent: Jan. 26, 2021

(54) EJECTION INSTRUCTING DEVICE, PRINT INSTRUCTING APPARATUS, AND INKJET-HEAD DRIVE CIRCUIT

(71) Applicant: FUJI XEROX CO., LTD., Tokyo (JP)

(72) Inventors: Fumiaki Sugiyama, Kanagawa (JP); Hiroyuki Tsuruoka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 189 days.

(21) Appl. No.: 15/977,059

(22) Filed: May 11, 2018

(65) Prior Publication Data

US 2018/0339508 A1 Nov. 29, 2018

(30) Foreign Application Priority Data

May 26, 2017 (JP) ..... 2017-104113

(51) Int. Cl.
*B41J 2/045* (2006.01)
*B41J 2/165* (2006.01)

(52) U.S. Cl.
CPC ..... *B41J 2/0451* (2013.01); *B41J 2/04586* (2013.01); *B41J 2/165* (2013.01); *B41J 2/16526* (2013.01); *B41J 2002/16529* (2013.01); *B41J 2002/16573* (2013.01)

(58) Field of Classification Search
CPC ..... B41J 2/2139; B41J 2/0451; B41J 2/2142; B41J 29/393; B41J 2/1652; B41J 2/16526; B41J 2002/16529; B41J 2/165; B41J 2002/16573; B41J 2/04501; B41J 2/16579
See application file for complete search history.

(56) References Cited

U.S. PATENT DOCUMENTS

2014/0152731 A1* 6/2014 Sato ..... B41J 2/04501 347/14

FOREIGN PATENT DOCUMENTS

JP 5874265 B2 3/2016

* cited by examiner

*Primary Examiner* — Jannelle M Lebron
(74) *Attorney, Agent, or Firm* — Oliff PLC

(57) ABSTRACT

An ejection instructing device includes an instructing unit, a generator, and a data generating controller. The instructing unit provides an instruction to cause a nozzle of a printer to eject droplets in accordance with ejection data for preventing a situation where the nozzle does not eject droplets caused by clogging. The generator generates ejection data for preventing a situation where the nozzle does not eject droplets caused by clogging and supplies the ejection data to the instructing unit. The data generating controller controls the generating of ejection data by the generator so that ejection data to be received by the instructing unit will satisfy an ejecting condition for preventing clogging of the nozzle.

9 Claims, 3 Drawing Sheets

EJECTION INSTRUCTING DEVICE, PRINT INSTRUCTING APPARATUS, AND INKJET-HEAD DRIVE CIRCUIT

CROSS-REFERENCE TO RELATED APPLICATIONS

This application is based on and claims priority under 35 USC 119 from Japanese Patent Application No. 2017-104113 filed May 26, 2017.

BACKGROUND

(i) Technical Field

The present invention relates to an ejection instructing device, a print instructing apparatus, and an inkjet-head drive circuit.

(ii) Related Art

Upon receiving print data described in a page description language (PDL) from an upstream system, a digital front end (DFE) executes a raster image processor (RIP) processing on the print data so as to generate a raster image. The DFE then transfers the generated raster image to a printer so as to cause the printer to form an image on a printing medium.

One type of printer which receives a raster image from the DFE and performs printing is an inkjet printer. The inkjet printer forms an image by ejecting ink droplets from nozzles. If the inkjet printer does not eject ink droplets for a long time, ink thickens in the nozzles, which decreases the ejection performance of the nozzles, or may cause the clogging of the nozzles in the worst case. To prevent the clogging of nozzles, a printer ejects ink droplets from the nozzles before printing or during printing, which is not for the purpose of forming an image on a printing medium.

In a continuous-sheet printer in which the positions of nozzles are fixed, for example, ejection data for preventing a situation where the nozzle does not eject droplets (may also called dummy data) is added to image data to be printed so that the nozzles can eject ink droplets.

SUMMARY

According to an aspect of the invention, there is provided an ejection instructing device including an instructing unit, a generator, and a data generating controller. The instructing unit provides an instruction to cause a nozzle of a printer to eject droplets in accordance with ejection data for preventing a situation where the nozzle does not eject droplets caused by clogging. The generator generates ejection data for preventing a situation where the nozzle does not eject droplets caused by clogging and supplies the ejection data to the instructing unit. The data generating controller controls the generating of ejection data by the generator so that ejection data to be received by the instructing unit will satisfy an ejecting condition for preventing clogging of the nozzle.

BRIEF DESCRIPTION OF THE DRAWINGS

An exemplary embodiment of the present invention will be described in detail based on the following figures, wherein.

DETAILED DESCRIPTION

An exemplary embodiment of the invention will be described below with reference to the accompanying drawings.

Figure 1:
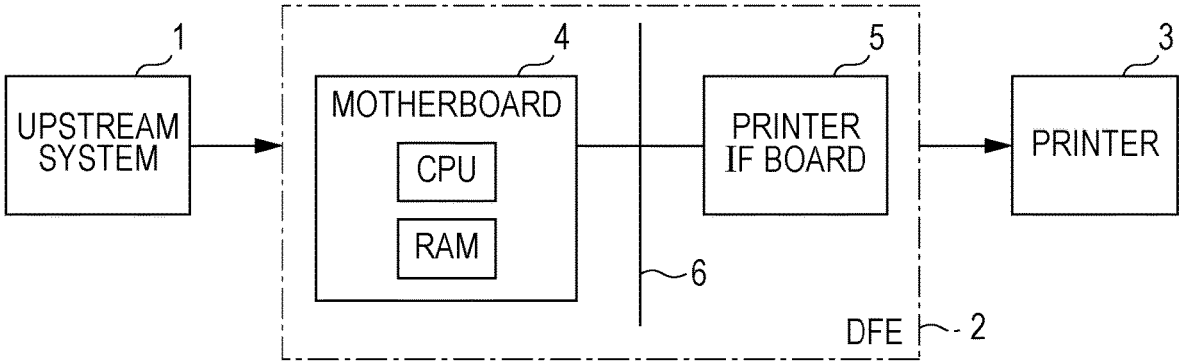
FIG. 1 is a schematic diagram illustrating the overall configuration of a print system according to the exemplary embodiment.

FIG. 1 is a schematic diagram illustrating the overall configuration of a print system according to the exemplary embodiment. In FIG. 1, the print system includes an upstream system 1, a digital front end (DFE) 2, and a printer 3. The upstream system 1 generates print data to be printed by the printer 3. The DFE 2 is a print instructing apparatus that provides a print instruction. More specifically, the DFE 2 executes raster image processor (RIP) processing on the print data generated by the upstream system 1 so as to generate a raster image, and sends the print data in the form of a raster image to the printer 3.

The DFE 2 includes a motherboard 4 and a printer interface (IF) board 5 connected to each other via an internal bus 6. The motherboard 4 includes a central processing unit (CPU) and a random access memory (RAM) installed thereon. The printer IF board 5 connects the DFE 2 to the printer 3. The internal bus 6 is a high-speed transmission line compliant with a connection standard called peripheral component interconnect express (PCIe).

Figure 2:
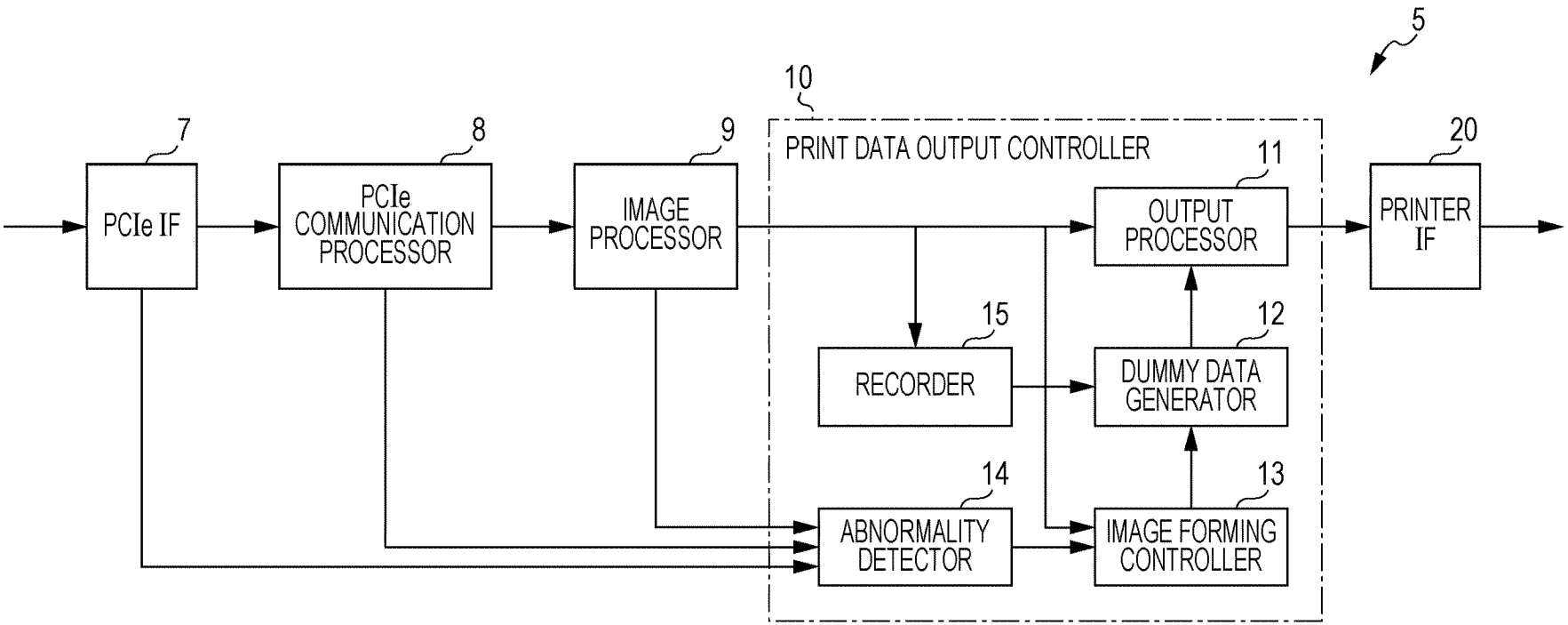
FIG. 2 is a block diagram illustrating the internal configuration of the printer interface (IF) board in the exemplary embodiment.

FIG. 2 is a block diagram illustrating the internal configuration of the printer IF board 5 in this exemplary embodiment. The printer IF board 5 includes a PCIe IF 7, a PCIe communication processor 8, an image processor 9, a print data output controller 10, a printer IF 20. The PCIe IF 7 is a communication unit that receives image data to be printed (print data) sent from the upstream system 1. The PCIe IF 7 serves as a so-called physical-layer communication model. The PCIe communication processor 8 is a communication unit that transfers print data sent from the upstream system 1 to a memory area used by the image processor 9 by means of direct memory access (DMA). The PCIe communication processor 8 serves as a so-called logical-layer communication model. The image processor 9 executes RIP processing on print data so as to output the print data in the form of a raster image. The print data output controller 10 supplies the raster-image print data to the printer IF 20. The printer IF 20 outputs the supplied print data to the printer 3.

The print data output controller 10 includes an output processor 11, a dummy data generator 12, an image forming controller 13, an abnormality detector 14, and a recorder 15. The output processor 11 outputs raster-image print data to the printer IF 20. To prevent the clogging of nozzles (not shown) of the printer 3 which causes a situation where the nozzles do not eject droplets, the output processor 11 outputs dummy data to the printer IF 20 and instructs the printer 3 to eject droplets from the nozzles in accordance with the dummy data. Dummy data output from the output processor 11 may be that generated by the dummy data generator 12 or may be that included in print data. Dummy data generated by the dummy data generator 12 and dummy data included in print data may be mixed with each other. The dummy data generator 12 generates dummy data and supplies it to the output processor 11.

The image forming controller 13 serves as a data generating controller that controls the generating of dummy data by the dummy data generator 12 so that the dummy data to be received by the output processor 11 will satisfy an ejecting condition for preventing the clogging of the nozzles. The abnormality detector 14 serves as an abnormality detector that detects the occurrence of an abnormality in the DFE 2. In the case of the occurrence of an error in the DFE 2, a corresponding one of the PCIe IF 7, the PCIe communication processor 8, and the image processor 9 sends an abnormality detection signal to the print data output controller 10. The abnormality detector 14 detects the occurrence of an abnormality as a result of receiving an abnormality detection signal from a corresponding one of the PCIe IF 7, the PCIe communication processor 8, and the image processor 9. Alternatively, the abnormality detector 14 may receive OK signals from the PCIe IF 7, the PCIe communication processor 8, and the image processor 9 at regular intervals, and may detect the occurrence of an abnormality when it has failed to receive an OK signal within a predetermined time.

The recorder 15 serves as a recorder that extracts dummy data included in print data supplied from the image processor 9 and records the extracted dummy data.

Dummy data is data used for causing the nozzles of the printer 3 to eject droplets, not for forming an image to be printed, but for preventing the clogging of the nozzles. To prevent the clogging of the nozzles, it is necessary to satisfy an ejecting condition such as that all the nozzles each eject droplets one hundred times within a range of ten inches. Each nozzle thus ejects droplets to satisfy the ejecting condition in accordance with a combination of image data and dummy data. Consequently, while referring to print data sent from the image processor 9, the image forming controller 13 controls the generating of the dummy data.

Flag information indicating a dummy data flag may be set in pixel data of each pixel forming print data. This makes it possible to determine whether the corresponding pixel represents dummy data.

The recorder 15 is then able to extract dummy data from the print data by referring to the flag information set in the print data. The image forming controller 13 is able to determine whether dummy data is included in the print data, and if it is, to recognize the position of each pixel representing the dummy data in the print data and the number of ejection times and ejection timings of each nozzle.

The output processor 11, the dummy data generator 12, the image forming controller 13, the abnormality detector 14, and the recorder 15 of the print data output controller 10 are implemented by cooperative operation of the CPU installed in the DFE 2 and a program operated by the CPU. The recorder 15 utilizes the RAM as a memory.

If any error occurs on the upstream side of the print data output controller 10, abnormal print data may be produced. For example, the entire or part of a sheet becomes black. In this case, the image forming controller 13 performs control so that such abnormal print data will not be output to the printer 3. Even if such abnormal print data is output to the printer 3, it may not be output from the printer 3. If the image forming controller 13 does not output print data to the printer 3 in this manner, dummy data is not output, either. Then, it is not possible to prevent the clogging of the nozzles.

To address this issue, in this exemplary embodiment, even in the case of the occurrence of an error which prevents the DFE 2 from outputting print data to the printer 3, in other words, even in the event of an accident which may cause the nozzles of the printer 3, at least dummy data can be output from the printer 3.

Figure 3:
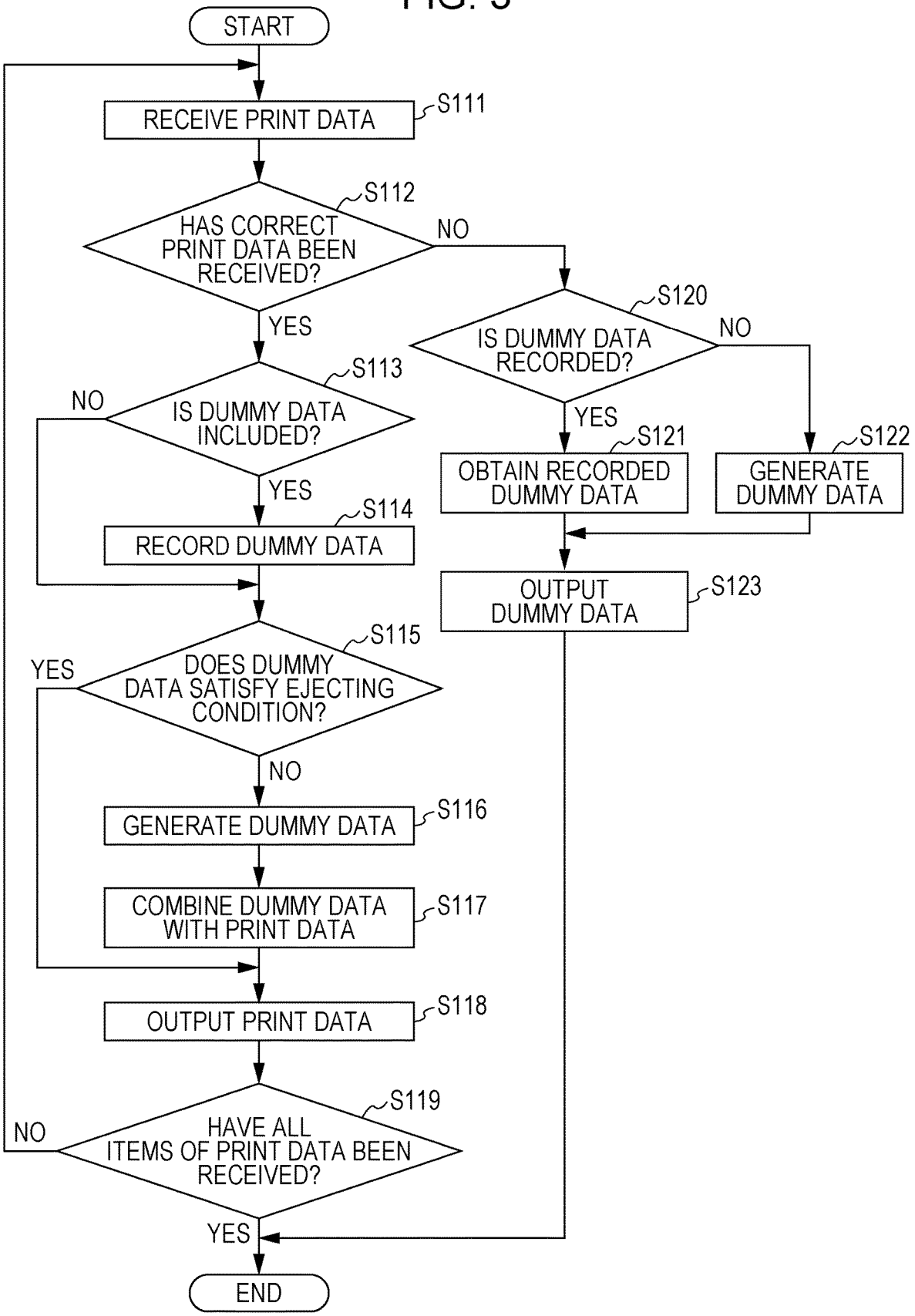
FIG. 3 is a flowchart illustrating processing executed by a print data output controller in the exemplary embodiment.

Control processing for outputting dummy data executed by the print data output controller 10 in this exemplary embodiment will be described below with reference to the flowchart of FIG. 3. In this exemplary embodiment, print data received by the printer IF board 5 from the upstream system 1 is an item of data having a predetermined data amount divided from a print job during the processing of the print data.

The PCIe IF 7 receives print data sent from the upstream system 1, and then, the PCIe communication processor 8 transfers the print data to the image processor 9. The image processor 9 then executes RIP processing on the print data so as to generate a raster image. As a result of this series of processing, in step S111, the print data output controller 10 receives the print data in the form of a raster image. The print data output controller 10 then determines in step S112 whether it has received correct print data, to put it another way, whether the abnormality detector 14 has received an abnormality detection signal from any of the PCIe IF 7, the PCIe communication processor 8, and the image processor 9. If the print data output controller 10 has received correct print data (YES in step S112), the recorder 15 determines in step S113 whether the print data includes dummy data. If dummy data is included in the print data (YES in step S113), the recorder 15 extracts the dummy data from the print data and records it in step S114. In this exemplary embodiment, the recorder 15 records the extracted dummy data within the recorder 15. However, the recorder 15 may record the dummy data in a separate memory. If dummy data is not included in the print data (NO in step S113), no dummy data is recorded.

Then, the image forming controller 13 determines in step S115 whether the dummy data included in the print data satisfies the ejecting condition. An example of the ejecting condition is such that all the nozzles each eject droplets one hundred times within a range of ten inches, as discussed above. If dummy data is not included in the print data (NO in step S113) or if dummy data included in the print data does not satisfy the ejecting condition, the image forming controller 13 determines that dummy data does not satisfy the ejecting condition (NO in step S115). For the sake of convenience, in this example, a description will be given, assuming that if dummy data is included in the control data, it satisfies the ejecting condition, unless otherwise stated.

If the ejecting condition is satisfied because the dummy data is included in the print data (YES in step S115), the output processor 11 outputs the print data to the printer IF 20 in step S118. As a result of the printer IF 20 sending the print data to the printer 3, the printer 3 starts printing. In this case, the clogging of the nozzles can be prevented because the dummy data satisfies the ejecting condition.

If the ejecting condition is not satisfied because dummy data is not included in the print data (NO in step S115), the image forming controller 13 causes the dummy data generator 12 to generate dummy data in step S116. In this case, the dummy data generator 12 generates dummy data that satisfies the ejecting condition. Then, in step S117, the output processor 11 combines the dummy data generated by the dummy data generator 12 with the print data sent from the image processor 9. In step S118, the output processor 11 outputs the print data to the printer IF 20. The dummy data combined with the print data satisfies the ejecting condition, and thus, the clogging of the nozzles can be prevented.

If dummy data included in the print data does not satisfy the ejecting condition, only print data may be output to the printer 3. In this case, however, printing of only the print data in the printer 3 does not necessarily prevent the clogging of the nozzles.

To address this issue, the print data output controller 10 executes the following processing. If the dummy data included in the print data sent from the image processor 9 does not satisfy the ejecting condition (NO in step S115), in step S116, the image forming controller 13 causes the dummy data generator 12 to generate dummy data which compensates for the dummy data included in the print data so that the resulting dummy data output from the output processor 11 will satisfy the ejecting condition. Then, in step S117, the output processor 11 combines the dummy data generated by the dummy data generator 12 with the print data sent from the image processor 9. In this manner, the output processor 11 mixes the dummy data generated by the dummy data generator 12 with the dummy data included in the print data so that the resulting dummy data will satisfy the ejecting condition. In step S118, the output processor 11 outputs the print data to the printer IF 20. In this case, the clogging of the nozzles can be prevented because the dummy data satisfies the ejecting condition.

The print data output controller 10 repeatedly executes the above-described processing on all items of print data included in the print job in step S119.

If the print data output controller 10 has not received correct print data (NO in step S112), the dummy data generator 12 generates dummy data. The result of step S112 becomes NO when the abnormality detector 14 has detected an abnormality. This may occur when the print data output controller 10 has received abnormal print data or when the print data output controller 10 has failed to receive print data.

In this case, if dummy data is recorded in the recorder 15 in step S114 (YES in step S120), the image forming controller 13 causes the dummy data generator 12 to obtain the dummy data recorded in the recorder 15 instead of to generate dummy data in step S121. If dummy data is not recorded in the recorder 15 in step S114 (NO in step S120), the image forming controller 13 causes the dummy data generator 12 to generate dummy data in step S122. In this case, the dummy data generator 12 generates dummy data which satisfies the ejecting condition.

In step S123, the output processor 11 outputs the dummy data to the printer IF 20, but does not output the print data which has not been correctly received. In this case, the clogging of the nozzles can be prevented because the dummy data satisfies the ejecting condition.

As discussed above, in this exemplary embodiment, not only when an abnormality is detected in the DFE 2, but also when dummy data which satisfies the ejecting condition is not included in correct print data, dummy data which satisfies the ejecting condition can be output to the printer 3. It is thus possible to prevent the clogging of nozzles.

As discussed above, to prevent the clogging of nozzles, it is necessary to eject droplets from the nozzles such as to satisfy the ejecting condition. A description has been given above for the sake of convenience, assuming that dummy data included in print data sent from the image processor 9 satisfies the ejecting condition. On the other hand, the print speed in the printer 3 may change for some reason. That is, even though dummy data included in print data sent from the image processor 9 satisfies the ejecting condition, it may fail to do so if the print speed in the printer 3 is decreased. The ejecting condition such as that all the nozzles each eject droplets one hundred times within a range of ten inches has been set, assuming that the printer 3 performs printing at a predetermined speed. Even though dummy data included in print data sent from the image processor 9 satisfies the ejecting condition, the nozzles may not be able to eject droplets such as to satisfy the ejecting condition if the print speed is decreased.

To address this issue, in this exemplary embodiment, the dummy data is generated so as to be adaptable to the print speed in the printer 3.

The print speed of the printer 3 is detectable by the printer IF 20. In step S115, the image forming controller 13 obtains the print speed of the printer 3 from the printer IF 20. If dummy data included in print data does not satisfy the ejecting condition at the detected print speed although it satisfies the ejecting condition when the printer 3 operates at the predetermined speed, the image forming controller 13 causes the dummy data generator 12 to generate dummy data so as to compensate for the dummy data included in the print data. This enables the nozzles to eject droplets such as to satisfy the ejecting condition at the detected print speed of the printer 3. As a result, the clogging of the nozzles can be prevented.

If the print speed of the printer 3 exceeds the predetermined speed, dummy data included in print data sent from the image processor 9 can still cause the nozzles to eject droplets such as to satisfy the ejecting condition. In this case, however, the nozzles eject droplets more than necessary to print this dummy data, and thus, the pixels representing the dummy data may be reduced. More specifically, the image forming controller 13 specifies the positions of pixels representing the dummy data to be reduced so that the dummy data generator 12 or the output processor 11 can eliminate these pixels. In this manner, the amount of droplets to be ejected from the nozzles, that is, the amount of ink consumed, is reduced.

In this exemplary embodiment, it is possible to prevent a situation where the nozzles do not eject droplets as described above. In this exemplary embodiment, the function of an ejection instructing device that causes nozzles to eject droplets is installed in the printer IF board 5 of the DFE 2. However, this function may be installed in a component of the printer 3, such as an inkjet-head drive circuit. Then, the function of causing nozzles to eject droplets is also implemented in a print system which does not utilize the DFE 2. If this function is installed in the printer 3, the printer 3 may detect the occurrence of an abnormality when it has failed to receive from the DFE 2 an OK signal indicating that the DFE 2 is operating under normal conditions.

This exemplary embodiment is applied to a printer in which the nozzles (or an inkjet head having nozzles) are fixed (not movable) and other nozzles are thus unable to perform droplet ejection instead of these nozzles, such as a continuous-sheet printer. However, the exemplary embodiment may also be applied to a printer having a movable inkjet head which allows other nozzles to perform droplet ejection instead of the nozzles installed in the inkjet head, such as a cut-sheet printer.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An ejection instructing device comprising:

a generator that generates ejection data for preventing a situation where the nozzle does not eject droplets caused by clogging;

an instructing unit that receives the ejection data from the generator, and that provides an instruction to cause a nozzle of a printer to eject droplets in accordance with the ejection data;

a data generating controller that controls the generating of ejection data by the generator so that ejection data to be received by the instructing unit will satisfy an ejecting condition for preventing clogging of the nozzle; and an abnormality detector that detects an occurrence of an abnormality in a print instructing apparatus, the print instructing apparatus providing a print instruction by sending print data to the printer, wherein, if an abnormality in which the print instructing apparatus is unable to send print data to the printer is detected by the abnormality detector, the data generating controller causes the generator to generate ejection data for preventing a situation where the nozzle does not eject droplets caused by clogging.

2. The ejection instructing device according to claim 1, further comprising:

a recorder that extracts, if ejection data for preventing a situation where the nozzle does not eject droplets caused by clogging is included in print data, the ejection data from the print data and records the extracted ejection data, wherein, if an abnormality in which the print instructing apparatus is unable to send the print data to the printer is detected by the abnormality detector during print processing for the print data, the data generating controller causes the generator to obtain the ejection data recorded by the recorder instead of to generate ejection data.

3. The ejection instructing device according to claim 1, wherein, if ejection data for preventing a situation where the nozzle does not eject droplets caused by clogging is not included in print data, the data generating controller causes the generator to generate ejection data.

4. The ejection instructing device according to claim 3, wherein the data generating controller causes the generator to generate ejection data for preventing a situation where the nozzle does not eject droplets caused by clogging such that the ejection data is adaptable to a print speed in the printer.

5. The ejection instructing device according to claim 1, wherein:

if ejection data for preventing a situation where the nozzle does not eject droplets caused by clogging is included in print data and if mere printing of the print data is not possible to cause the nozzle to eject droplets such as to satisfy the ejecting condition, the data generating controller causes the generator to generate ejection data which compensates for the ejection data included in the print data, so that ejection data to be received by the instructing unit will satisfy the ejecting condition; and the instructing unit provides an instruction to cause the nozzle to eject droplets in accordance with the ejection data included in the print data and the ejection data generated by the generator.

6. The ejection instructing device according to claim 5, wherein, if ejection data which satisfies the ejecting condition for preventing a situation where the nozzle does not eject droplets caused by clogging is not included in print data, the data generating controller causes the generator to generate ejection data.

7. The ejection instructing device according to claim 5, wherein, if a print speed in the printer is slower than a predetermined speed, the data generating controller causes the generator to generate ejection data for preventing a situation where the nozzle does not eject droplets caused by clogging.

8. A print instructing apparatus comprising:

an ejection instructing device including a generator that generates ejection data for preventing a situation where the nozzle does not eject droplets caused by clogging and supplies the ejection data to the instructing unit, an instructing unit that receives the ejection data from the generator, and that provides an instruction to cause a nozzle of a printer to eject droplets in accordance with the ejection data, a data generating controller that controls generating of ejection data by the generator so that ejection data to be received by the instructing unit will satisfy an ejecting condition for preventing clogging of the nozzle, and an abnormality detector that detects an occurrence of an abnormality in a print instructing apparatus, the print instructing apparatus providing a print instruction by sending print data to the printer, wherein, if an abnormality in which the print instructing apparatus is unable to send print data to the printer is detected by the abnormality detector, the data generating controller causes the generator to generate ejection data for preventing a situation where the nozzle does not eject droplets caused by clogging.

9. An inkjet-head drive circuit comprising:

an ejection instructing device including a generator that generates ejection data for preventing a situation where the nozzle does not eject droplets caused by clogging and supplies the ejection data to the instructing unit, an instructing unit that receives the ejection data from the generator, and that provides an instruction to cause a nozzle of a printer to eject droplets in accordance with the ejection data, a data generating controller that controls generating of ejection data by the generator so that ejection data to be received by the instructing unit will satisfy an ejecting condition for preventing clogging of the nozzle, and an abnormality detector that detects an occurrence of an abnormality in a print instructing apparatus, the print instructing apparatus providing a print instruction by sending print data to the printer, wherein, if an abnormality in which the print instructing apparatus is unable to send print data to the printer is detected by the abnormality detector, the data generating controller causes the generator to generate ejection data for preventing a situation where the nozzle does not eject droplets caused by clogging.

* * * * *